United States Patent [19]

Duhamel

[11] 4,412,489

[45] Nov. 1, 1983

[54] SMALL PRINTING MACHINE

[75] Inventor: Claude-Alain Duhamel, Paris, France

[73] Assignee: Librairie Fernand Nathan, Paris, France

[21] Appl. No.: 299,488

[22] Filed: Sep. 4, 1981

[30] Foreign Application Priority Data

Feb. 11, 1981 [FR] France ..... 81 02666

[51] Int. Cl.[3] ..... B41F 5/00; B41F 27/06

[52] U.S. Cl. ..... 101/212; 101/377; 101/335

[58] Field of Search ..... 101/212, 216, 219, 370, 101/372, 373, 377, 380, 381, 269, 172, 335; 434/81, 84, 85; 400/662

[56] References Cited

U.S. PATENT DOCUMENTS

| | | | |
|---|---|---|---|
| 772,337 | 10/1904 | Brown | 101/216 |
| 835,903 | 11/1906 | Grant | 101/216 X |
| 1,560,211 | 11/1925 | Chisholm | 101/377 |
| 2,190,740 | 2/1940 | Swift et al. | 101/216 |
| 2,432,202 | 12/1947 | Mason | 101/227 |
| 2,774,816 | 12/1956 | Yost | 400/320 X |
| 3,349,702 | 10/1967 | Nesin et al. | 101/DIG. 13 |

*Primary Examiner*—Edgar S. Burr
*Assistant Examiner*—David A. Wiecking
*Attorney, Agent, or Firm*—Murray Schaffer

[57] ABSTRACT

The machine comprises a table for guiding paper to be printed which table is bordered by two vertical side walls supporting a rotary drum. A part of the outer surface of the drum includes ribs for hooking elastic printing forms carrying portions in relief. The table also includes a transverse slot for receiving a colored litho chalk against which chalk the reliefs press the paper so that the pattern of these reliefs are printed thereon and the paper is driven along.

14 Claims, 4 Drawing Figures

FIG. 3
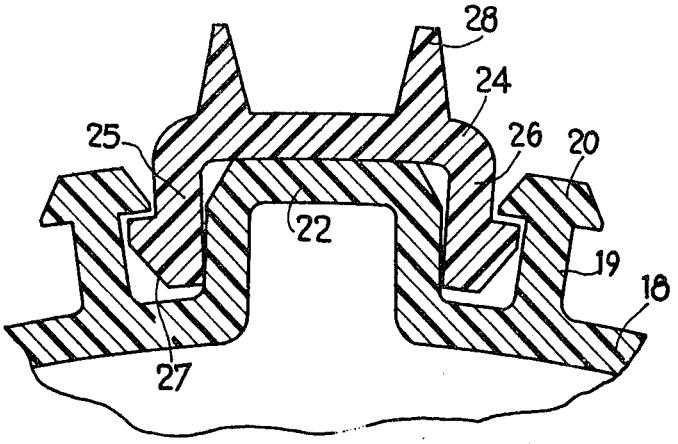
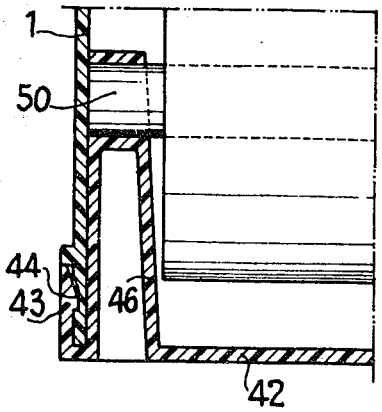
FIG. 4

SMALL PRINTING MACHINE

DESCRIPTION

Small printing machines intended to constitute a toy and subsequently to be employed by children, at the present time have the serious drawback of requiring the inking of the printing forms carried by the rotary cylinder which renders their handling difficult. Now, these forms must be handled each time that the composition must be modified and such a modification is frequent when it concerns a toy.

Further, these machines are often complicated in design and are consequently expensive.

An object of the present invention is to overcome these drawbacks while avoiding the risk of marks or spots produced by the inking of the forms and thus to provide a simple machine which may be employed even by young children.

The invention consequently provides a small printing machine which comprises a table for guiding the paper to be printed and interrupted by a transverse slot for receiving a stick of greasy chalk, and a rotary cylinder disposed above said slot and having a part of its outer surface which carries ribs for hooking forms and having reliefs whose thickness exceeds the distance, at rest, between the ribs and the chalk so that, when the cylinder rotates, said reliefs apply the paper against the chalk which prints the reliefs on the lower side of the paper.

In such a machine, the printing is achieved on the lower side of the paper by the pressure exerted by reliefs of the forms on the paper and on the chalk. Between these elements in relief, the chalk leaves no trace on the paper. Further, the printing forms remain clean since they are in contact with the paper on the unprinted side of the latter.

In a preferred embodiment of the invention, the chalk is placed in a removable drawer which contains an elastically yieldable pad which biases the chalk toward the table and the rotary cylinder.

Consequently the chalk may be replaced whenever desired and its colour consequently modified.

In a preferred embodiment, the table is part of a stand which comprises a reserve supply of paper in the form of a reel which can be continuously unwound.

According to another feature of the invention, the rotary cylinder is provided with a sleeve carrying ribs and the latter are provided with heads for hooking the elastic printing forms so that the latter are easily removable but firmly held on the cylinder.

The ensuing description of an embodiment of the invention, which is given merely by way of example and shown in the accompanying drawings, will bring out the advantages and features of the invention.

IN THE DRAWINGS:

FIG. 3 is a sectional view to an enlarged scale of the detail A of FIG. 1, and FIG. 4 is a sectional view taken on line 4—4 of FIG. 1.

Figure 2:
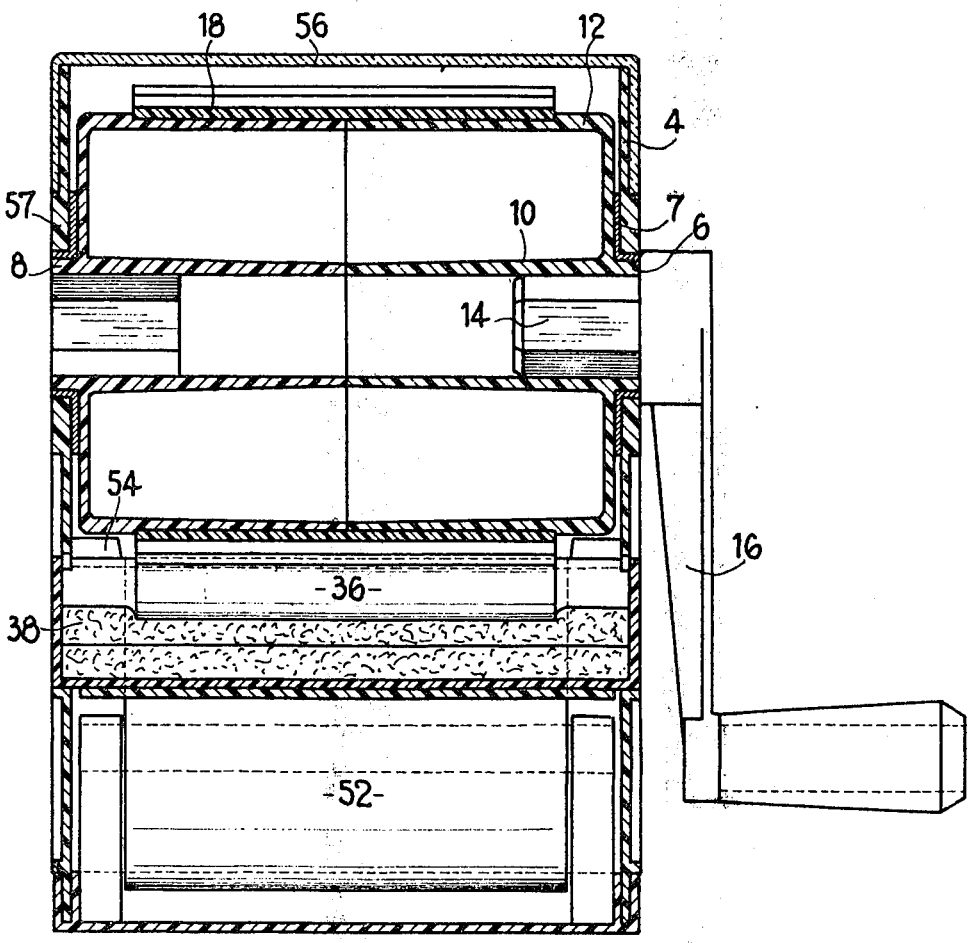
FIG. 2 is a sectional view taken on line 2—2 of FIG. 1.

The printing machine shown in the drawings comprises a stand 1 forming a table 2 on each side of which extend upwardly two vertical parallel side walls 4. The two side walls are provided with two identical coaxial apertures in which are mounted end portions 6 and 8 of a shaft 10 of a drum 12. A bearing 7 is interposed between each of the end portions 6 and 8 respectively and the corresponding side wall 4 so that these end portions are freely journalled in the side walls and the drum is rotatable relative to the stand 1. For this purpose, the inner surface of each of the end portions 6 and 8 has a polygonal cross-sectional shape for the purpose of cooperating with an end portion 14 which is of corresponding shape and is rigid with a manual driving means such as a crank 16 (FIG. 2).

The drum 12 carries on the outer surface thereof a sleeve 18 provided with outer ribs which are parallel to the axis of the drum. At least some of these ribs 19 include an enlarged head 20 constituting a hooking element. In the embodiment shown in FIGS. 1 and 3, the ribs 19, provided with hooking heads 20, alternate with wide ribs 22. These ribs effectively cooperate with printing forms 24 which include lower branches 25 and 26 terminating in hooks 27. Such a printing form may be fitted on the wide rib 22 so that the two branches 26 and 25 enter the space between the rib 22 and the neighbouring ribs 19 and the two hooks 27 lock against the adjacent hooking heads 20.

The forms 24 are made from an elastic material so that they may be placed in position and withdrawn easily.

It will be understood that the printing form 24 include reliefs 28 which constitute the printing element and represents the contour of a letter, a shape or any other design to be printed.

Directly below the rotary drum 12, the table 2 is interrupted by a transverse slot 30 whose upper part is divergent and defined by two opposed inclined transverse walls, respectively 31 and 33, and which forms a cavity 32 for a removable drawer 34. Inside the latter, a stick of a coloured greasy chalk 36 of substantially cylindrical shape bears on an elastic element 38 for example formed by two layers of a foam material. The elastic element 38 upwardly biases the chalk 36, i.e. outwardly of the drawer, and normally maintains it substantially at the level of the table 2. Further, the outside radius of the ribs 19 and 22 is substantially equal to the distance between the axis of rotation of the drum 12 and the upper surface of the table 2 so that, when the drum 12 is driven in rotation, the ribs of the sleeve 18 become substantially flush with the chalk 36 without touching it. On the other hand, if the forms 24 are secured to the ribs 22, 19, the reliefs 28 successively apply the paper against the table at the edge 35 of the slot 30 and drive it in the direction of the chalk 36 and then cause this paper to rub against the chalk 36 which is upwardly biased by the elastic element 38. The paper issues from the slot 30 freely without contact with the reliefs since the wall 33 is much more inclined than the input wall 31.

Figure 1:
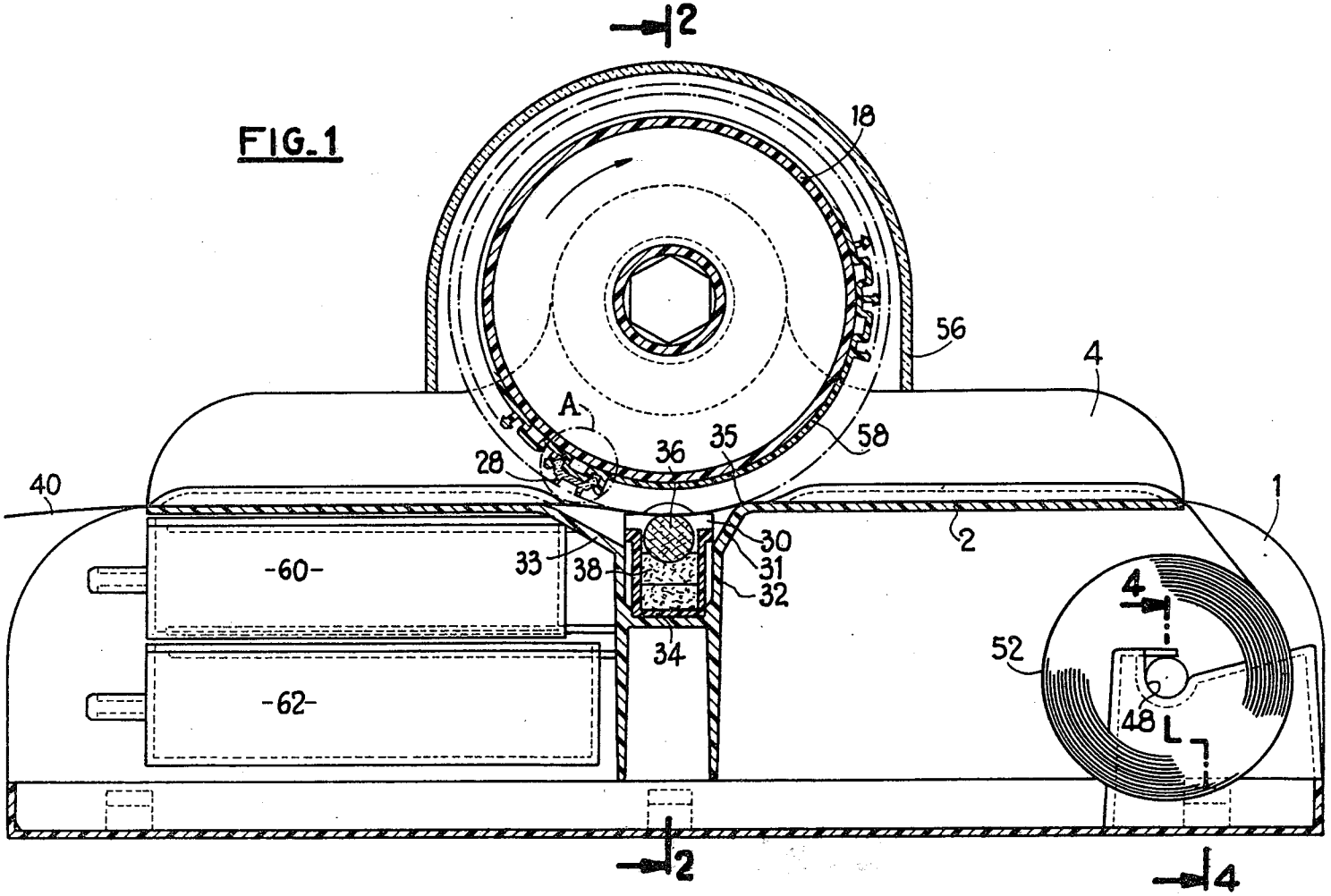
FIG. 1 is a longitudinal sectional view of a printing machine according to the invention.

Thus, when letters or figures defined by the reliefs 28 are desired to be printed on a sheet of paper 40, the latter is placed on the table 2, at the right end of the latter as viewed in FIG. 1, and it is slid along this table between the chalk 36 and the drum 12. Then the drum is driven in rotation by means of the crank 16 in the clockwise direction as viewed in FIG. 1, namely in the direction from the wall 31 to the wall 33. It will be understood that when the reliefs 28 come in contact with the paper 40 and the chalk 36, they press these two elements against each other and the colour of the chalk is printed on the paper. As the drum 12 continuous to rotate, the paper is driven by this motion and is displaced along the table 2.

When the drum 12 has effected a complete rotation, the lower side of the paper 40 has received all of the prints corresponding to the forms 24 carried by the drum. This paper may be permanently withdrawn or re-introduced so as to be once again printed on the other side thereof with the same forms or with other forms, since the latter are easily detachable.

In the illustrated embodiment, the stand 1 is hollow and closed in the lower part thereof by a bottom 42 provided with a vertical flange 43 which enables the bottom to be fixed in position by a clipping into a corresponding groove 44 provided in the stand. This bottom 42 is furthermore rigid with two side walls 46 each of which defines a semicircular recess 48 in which is journalled the end portion of the shaft 50 of a reel of a reserve supply of paper 52. Consequently the printing machine may be continuously fed with paper and the printing reproduced as many times as desired on the paper from the reel 52 which is unwound under the driving effect of the reliefs 28.

Preferably, the table has along each side wall 4 a longitudinal boss 54 which guides the paper 40 and facilitates the centering thereof. The bosses or ramps 54 also facilitate the centering of the drum 12 in that they project on each side of the sleeve 18.

The machine may be rendered even more clean and safe in operation by the addition of a semi-cylindrical hood 56 whose diameter is slightly greater than the diameter of the drum 12 and is capable of being fitted on the side walls 4. Each of these side walls indeed preferably includes an annular thicker portion 57 around the aperture for the passage of the chalk 10 of the drum 12 and the hood 56 has lateral openings of corresponding shape so that it bears against the thickened portions 57 of the side walls 4. The hood provides moreover a support which enables the machine to be held in position during the rotation of the crank and thus facilitates this rotation. The hood is preferably transparent so that the child using the machine can see the graphic signs rotating and thus supervise the drum notwithstanding the presence of the hood.

Preferably, the sleeve 18 is not provided with ribs throughout its surface but has a smooth part corresponding to for example $\frac{1}{4}$ or 1/5 of the length of its circumference. Thus, in order to introduce the paper 40 between the drum and the table 2, it is sufficient to place this drum in such manner that the smooth part 58 of the sleeve 18 is in facing relation to the slot 30 and the chalk 36, which leaves a space for the passage of the paper between the drum and the table 2 on each side of the transverse slot 30. The procedure is thus extremely simple and all the parts are easily seen. Even a young child may consequently use the machine without difficulty.

Note that the forms 24 carry the characters or shapes in relief the right way round, exactly as they will be printed on the paper and are consequently easily recognisable by a child who may easily compose a group of letters and patterns which he will find printed as such on the paper. Further, these forms are never in contact with the chalk 36 and remain intact, even after a large number of utilisations. Further, the chalk itself may be handled without danger since coloured litho chalks do not mark upon simple contact and require a relatively high pressure in order to leave a mark.

The slot 30 is preferably open at both ends so that the drawer can be slid in position in either direction. Likewise, the crank 16 may be placed as desired at the end 6 or at the end 8 of the shaft 10 of the drum. In this way, the use of the machine is very simply highly facilitated either with the left hand or right hand.

The stand 1 may moreover be employed not only as a storage space for paper but also as a store for the printing forms, the chalks or any other element. For this purpose, the stand 1 may include, as shown in FIG. 1, one or more drawers 60, 62 or any other storage means.

The whole of the machine is preferably made by moulding a plastics material or the like, but it will be understood that it may also be made from any other material.

The shape of the ribs carried by the sleeve 18 may be modified in accordance with their utilisation and the mode of hooking the printing forms. The diameter of the drum and the axial dimension thereof may also vary, but they are preferably chosen in accordance with conventional formats of commercially-available paper sheets. For example, a drum carrying ribs on a length of 29.7 cm would preferably have an effective axial dimension of 10.5 cm so that it is possible to very simply print sheets of standard format cut in two.

Having now described my invention what I claim as new and desire to secure by Letters Patent is:

1. A printing machine comprising a table for guiding paper to be printed, means defining a slot extending transversely of the table, a stick of coloured greasy chalk disposed parallel to and located in said slot, a rotary drum located above said slot and rotatable about an axis parallel to said slot and having on a part of an outer surface thereof ribs which are disposed on a first imaginary geometric cylinder coaxial with said drum and are for receiving and hooking printing forms, printing forms which are in hooked relation to said ribs and have reliefs, the reliefs defining outer surfaces which are disposed on a second imaginary geometric cylinder which is coaxial with said drum and has a radius which exceeds the radius of said first imaginary geometric cylinder, and means for biasing the stick of chalk and said outer surfaces of said printing forms against one another whereby, upon rotation of the drum with a sheet of paper between the drum and the stick of chalk, said outer surfaces of the reliefs apply the paper against the stick of chalk which prints the shape of the outer surfaces of the reliefs on a side of the paper remote from the drum as the paper is displaced transversely across the stick of chalk by the rotation of the outer surfaces of the reliefs about said axis.

2. A machine according to claim 1, wherein the stick of chalk is in bearing relation to an elastically yieldable means which biases the stick of chalk in the direction of the drum and constitutes said means for biasing the stick of chalk and said outer surfaces of said printing forms against one another.

3. A machine according to claim 1, wherein the stick of chalk is placed in a removable drawer.

4. A machine according to claim 1, wherein the ribs of the rotary drum are provided with hooking heads which cooperate with lower hooks of supports of said forms.

5. A machine according to claim 1, wherein the rotary drum comprises wide ribs of said ribs which alternate with narrow ribs of said ribs which narrow ribs are provided with hooking heads, each form comprising lower branches terminating in hooks which are capable of being locked between two adjacent ribs.

6. A machine according to any one of the claims 1 to 5, wherein the rotary drum comprises means defining an axial cylindrical cavity, two end portions of which cavity have a polygonal cross-sectional shape and are cooperable with a detachable driving crank provided with an end portion of corresponding cross-sectional shape.

7. A machine according to any one of the claims 1 to 5, wherein the table for guiding the paper is bordered laterally by two side walls in which side walls the rotary drum is journalled.

8. A machine according to any one of the claims 1 to 5, further comprising on the table two parallel lateral bosses for guiding and centering the paper.

9. A machine according to any one of the claims 1 to 5, wherein the table is carried by a stand which constitutes a storage compartment for the paper and includes means for supporting the shaft of a reel of a reserve supply of paper.

10. A machine according to claim 7, comprising a holding and protecting hood which is fitted on rounded end portions of the side walls.

11. A machine according to claim 9, wherein the stand includes other storing means.

12. A machine according to claim 11, wherein said other storing means are drawers.

13. A machine according to any one of the claims 1 to 5, wherein on an input side of the slot the reliefs of each form come successively into driving contact with the paper to be printed placed on the table while on an output side of said slot a free space exists therebetween.

14. A machine according to claim 1, wherein said means for biasing the stick of chalk and said outer surfaces of said printing forms comprise a layer of elastically compressible plastic foam material interposed between the stick of chalk and support means for the stick of chalk.

* * * * *